US012799660B2

(12) United States Patent
Yu et al.

(10) Patent No.: US 12,799,660 B2
(45) Date of Patent: Nov. 17, 2026

(54) METHOD FOR CONTROLLING CLOTHING TREATMENT APPARATUS

(71) Applicant: LG Electronics Inc., Seoul (KR)

(72) Inventors: Seonhwa Yu, Seoul (KR); Jaehyun Kim, Seoul (KR); Hyunseok Seo, Seoul (KR)

(73) Assignee: LG Electronics Inc., Seoul (KR)

( * ) Notice: Subject to any disclaimer, the term of this patent is extended or adjusted under 35 U.S.C. 154(b) by 137 days.

(21) Appl. No.: 18/700,074

(22) PCT Filed: Oct. 11, 2022

(86) PCT No.: PCT/KR2022/015310

§ 371 (c)(1),
(2) Date: Apr. 10, 2024

(87) PCT Pub. No.: WO2023/063686

PCT Pub. Date: Apr. 20, 2023

(65) Prior Publication Data

US 2025/0237003 A1 Jul. 24, 2025

(30) Foreign Application Priority Data

Oct. 12, 2021 (KR) ..... 10-2021-0134714

(51) Int. Cl.
*D06F 37/36* (2006.01)
*D06F 39/08* (2006.01)
(Continued)

(52) U.S. Cl.
CPC ..... *D06F 37/36* (2013.01); *D06F 39/088* (2013.01); *D06F 2103/06* (2020.02); *D06F 2105/10* (2020.02); *D06F 2105/48* (2020.02)

(58) Field of Classification Search
None
See application file for complete search history.

(56) References Cited

U.S. PATENT DOCUMENTS 5,897,672 A 4/1999 Badami et al.
2015/0047128 A1* 2/2015 Goshgarian ..... D06F 34/18 8/137
2020/0109504 A1* 4/2020 Im ..... D06F 34/18

FOREIGN PATENT DOCUMENTS

CN 109554889 4/2019
DE 102009001271 A1 9/2010
(Continued)

OTHER PUBLICATIONS

CN 110863322 A machine translation, Laundry Treatment Device And Its Operation Method, Schaumann (Year: 2020).*
(Continued)

*Primary Examiner* — Cristi J Tate-Sims
(74) *Attorney, Agent, or Firm* — Fish & Richardson P.C.

(57) ABSTRACT

The present application relates to a clothing treatment apparatus comprising: an acceleration step of accelerating a drum so that the number of revolutions thereof reaches a preset reference number of revolutions; a material-distinguishing step of distinguishing clothing materials according to whether an average value of current supplied to a stator during the time taken until the reference number of revolutions is reached is greater than or equal to a preset reference value; a water supply step of supplying water to a tub; and a treatment step of separating foreign substances from the clothing by rotating the drum, wherein, in the treatment step, the temperature of the water stored in the tub and/or the number of revolutions of the drum is controlled to differ according to the clothing material confirmed through the material-distinguishing step.

16 Claims, 6 Drawing Sheets

(51) Int. Cl.

| | |
|---|---|
| *D06F 103/06* | (2020.01) |
| *D06F 105/10* | (2020.01) |
| *D06F 105/48* | (2020.01) |

(56) References Cited

FOREIGN PATENT DOCUMENTS

| | | | |
|---|---|---|---|
| EP | 3162942 | A1 | 5/2017 |
| JP | 2019-017832 | | 2/2019 |
| KR | 10-2018-0083827 | | 7/2018 |
| KR | 10-2018-0093069 | | 8/2018 |
| KR | 10-2020-0026043 | | 3/2020 |

OTHER PUBLICATIONS

CN 1345994 A machine translation, Washing Mode Judging Device And Method Thereof, Li (Year: 2002).*
Extended European Search Report in European Appln. No. 22881313.5, mailed on Sep. 16, 2025, 9 pages.
International Search Report and Written Opinion in International Appln. No. PCT/KR2022/015310, mailed on Feb. 9, 2023, 19 pages (with English translation).
Office Action in Korean Appln. No. 10-2021-0134714, mailed on Sep. 10, 2026, 16 pages (with English translation).

* cited by examiner

METHOD FOR CONTROLLING CLOTHING TREATMENT APPARATUS

CROSS-REFERENCE TO RELATED APPLICATIONS

This application is a National Stage application under 35 U.S.C. § 371 of International Application No. PCT/KR2022/015310, filed Oct. 11, 2022, which claims the benefit of Korean Application No. 10-2021-0134714, filed on Oct. 12, 2021. The disclosures of the prior applications are incorporated by reference in their entirety.

TECHNICAL FIELD

The present disclosure relates to a laundry treatment apparatus and a method for controlling the same.

BACKGROUND ART

Generally, a laundry treatment apparatus may refer to an apparatus for washing clothes, an apparatus for drying wet or washed clothes, and/or an apparatus for performing washing and drying of clothes.

A conventional laundry treatment apparatus may include a tub to store water, a drum rotatably provided in the tub to store clothes to be washed and/or dried, and a motor to provide power necessary for rotation of the drum.

A representative example from among conventional laundry treatment apparatuses has been designed to determine the type of clothes to be treated in the drum and to adjust the amount of water supplied to the tub or the number of revolutions (e.g., RPM) of the drum according to the type of clothes to be treated.

A representative example of the conventional laundry treatment apparatus has been disclosed in Korean Patent Laid-Open Publication No. 10-2001-0105608, which includes a water supply step of supplying water into the tub, a step of rotating the drum after completion of the water supply step, a step of measuring the amount of current supplied to a motor during rotation of the drum, and a step of distinguishing the types of clothes according to the measured amount of current.

The control method for classifying the types of clothes through the above-described process involves supplying water to the tub and then rotating the drum, so that the amount of current supplied to the motor to rotate the drum varies depending on the degree to which the laundry absorbs water. Therefore, the control method for distinguishing the types of laundry provided in the conventional laundry treatment apparatus is merely a method of classifying laundry into laundry with a high water absorption rate and laundry with a low water absorption rate, but the control method has difficulty in distinguishing whether laundry is made of a soft material and laundry is made of a stiff material.

DISCLOSURE

Technical Problem

An object of the present disclosure is to provide a method for controlling a laundry treatment apparatus that can distinguish between clothing made of a soft material and clothing made of a stiff material.

Another object of the present disclosure is to provide a method for controlling a laundry treatment apparatus that can distinguish a thickness of laundry for each material of laundry.

Another object of the present disclosure is to provide a method for controlling a laundry treatment apparatus that varies a treating process of laundry depending on the material and thickness of laundry.

Technical Solutions

In accordance with an embodiment of the present disclosure, there is provided a method for controlling a laundry treatment apparatus that includes a tub to store water therein, a drum provided inside the tub to accommodate clothes, a stator to form a rotating magnetic field, and a rotor rotated by the rotating magnetic field and connected to the drum through a rotary shaft.

The control method may include an acceleration step of accelerating the drum so that a revolutions per minute (RPM) of the drum increases to a preset reference RPM; a material-distinguishing step of distinguishing materials of clothes according to whether an average value of a current supplied to the stator during a time taken to reach the reference RPM is greater than or equal to a preset reference value; a water supply step of supplying water to the tub; and a treating step of rotating the drum to separate foreign substances from the clothes.

The treating step may differently control at least one of a temperature of the water stored in the tub and the RPM of the drum depending on the material of clothes confirmed through the material-distinguishing step.

The reference RPM may be set to an RPM that causes centrifugal force of 1G to the clothes located inside the drum.

The acceleration step may include controlling acceleration of the drum to be maintained at 1 rpm/s to 10 rpm/s.

The acceleration step may include controlling acceleration of the drum to be maintained at 3 rpm/s to 5 rpm/s.

The material-distinguishing step may include, if the average value of the current supplied to the stator during the time taken to reach the reference RPM is greater than or equal to the reference value, determining a material of the clothes to be a first material in which a polyester content of the clothes put into the drum is 80% or more.

The material-distinguishing step may include, if the average value of the current supplied to the stator during the time taken to reach the reference RPM is less than the reference value, determining a material of the clothes to be a second material in which a polyester content of the clothes put into the drum is less than 80%.

If the clothes made of the first material are confirmed to be the clothes having the first thickness, the treating step may include a heating step of heating the water to 30° C.

If the clothes made of the first material are confirmed to be the clothes having the first thickness, the treating step may include a step of executing a first motion in which clockwise rotation of the drum and counterclockwise rotation of the drum are alternately performed and the drum rotates at a first RPM at which centrifugal force of less than 1G occurs.

If the clothes made of the first material are confirmed to be the clothes having the second thickness, the treating step may include a heating step of heating the water to 30° C.

If the clothes made of the first material are confirmed to be the clothes having the first thickness, the treating step may include a second motion execution step of causing centrifugal force of less than 1G and rotating the drum at a second RPM higher than the first RPM.

The method may further include a thickness-distinguishing step of distinguishing a thickness of clothes according to whether a deviation per unit time of the current supplied to the stator during the material-distinguishing step is less than a preset reference deviation.

If a deviation per unit time of the current supplied to the stator during the material-distinguishing step is less than a preset reference deviation, the thickness-distinguishing step may include determining a thickness of the clothes to be a first thickness smaller than the reference thickness.

If the deviation per unit time of the current supplied to the stator during the material-distinguishing step is greater than or equal to the reference deviation, the thickness-distinguishing step may determine a thickness of the clothes to be a second thickness larger than the reference thickness.

If the clothes made of the first material are confirmed to be the clothes having the first thickness, the treating step may include: a heating step of heating the water to 30° C.; and a step of executing a first motion in which clockwise rotation of the drum and counterclockwise rotation of the drum are alternately performed and the drum rotates at a first RPM at which centrifugal force of less than 1G occurs.

When the inner space of the drum is divided into an upper space located above a horizontal line passing through the center of rotation of the drum and a lower space located below the horizontal line, the first RPM may be set to an RPM at which clothes inside the drum can move in the lower space.

If the clothes made of the first material are confirmed to be the clothes having the second thickness, the treating step may include a heating step of heating the water to 30° C.; and a second motion execution step of causing centrifugal force of less than 1G and rotating the drum at a second RPM higher than the first RPM.

If the clothes made of the first material are confirmed to be the clothes having the second thickness, the treating step may include: a heating step of heating the water to 30° C.; a first motion execution step of alternately performing clockwise rotation of the drum and counterclockwise rotation of the drum, and rotating the drum at the first RPM at which centrifugal force of less than 1G occurs; and a second motion execution step of causing centrifugal force of less than 1G and rotating the drum at a second RPM higher than the first RPM.

The first motion execution step and the second motion execution step may be executed alternately.

If the clothes made of the second material are confirmed to be the clothes having the first thickness, the treating step may include: a heating step of heating the water to 40° C.; and a first motion execution step of performing the first motion.

If the clothes made of the second material are confirmed to be the clothes having the second thickness, the treating step may include: a heating step of heating the water to 40° C.; and a second motion execution step of causing centrifugal force of less than 1G and rotating the drum at a second RPM higher than the first RPM.

In accordance with another embodiment of the present disclosure, a method for controlling a laundry treatment apparatus that includes a tub to store water therein, a drum provided inside the tub to accommodate clothes, a stator to form a rotating magnetic field, and a rotor rotated by the rotating magnetic field and connected to the drum through a rotary shaft, the method may include: an acceleration step of accelerating the drum so that a revolutions per minute (RPM) of the drum increases to a preset reference RPM; a material-distinguishing step of decelerating the drum so that an RPM of the drum decreases to a deceleration reference RPM lower than the reference RPM; distinguishing materials of clothes according to whether an average value of a current supplied to the stator during a time taken to reach the deceleration reference RPM is greater than or equal to a preset reference value; a water supply step of supplying water to the tub; and a treating step of rotating the drum to separate foreign substances from the clothes.

The treating step may differently control at least one of a temperature of the water stored in the tub and the RPM of the drum depending on the material of clothes confirmed through the material-distinguishing step.

The deceleration step may include controlling acceleration of the drum to be maintained at −3 rpm/s to −5 rpm/s.

In accordance with another embodiment of the present disclosure, there is provided a method for controlling a laundry treatment apparatus including a drum that provides a space for accommodating an object to be treated, a stator forming a rotating magnetic field, and a rotor rotated by the rotating magnetic field and connected to the drum through a rotary shaft. The method may include accelerating the drum so that an RPM of the drum increases to a preset reference speed; a material-distinguishing step of distinguishing the material of the object to be treated according to whether an average value of a current supplied to the stator is greater than or equal to a preset reference value during a time taken to reach the reference speed; and a treating step of differently controlling the rotation speed of the drum depending on the material of the object confirmed through the distinguishing step.

Advantageous Effects

As is apparent from the above description, a method for controlling the laundry treatment apparatus according to the embodiments of the present disclosure can distinguish between clothing made of a soft material and clothing made of a stiff material.

The method for controlling the laundry treatment apparatus according to the embodiments of the present disclosure can distinguish a thickness of laundry for each material of laundry.

The method for controlling the laundry treatment apparatus according to the embodiments of the present disclosure can vary a treating process of laundry depending on the material and thickness of laundry.

BEST MODE

Hereinafter, preferred embodiments of the laundry treatment apparatus and the control method of the laundry treatment apparatus will be described in detail with reference to the attached drawings.

Figure 1:
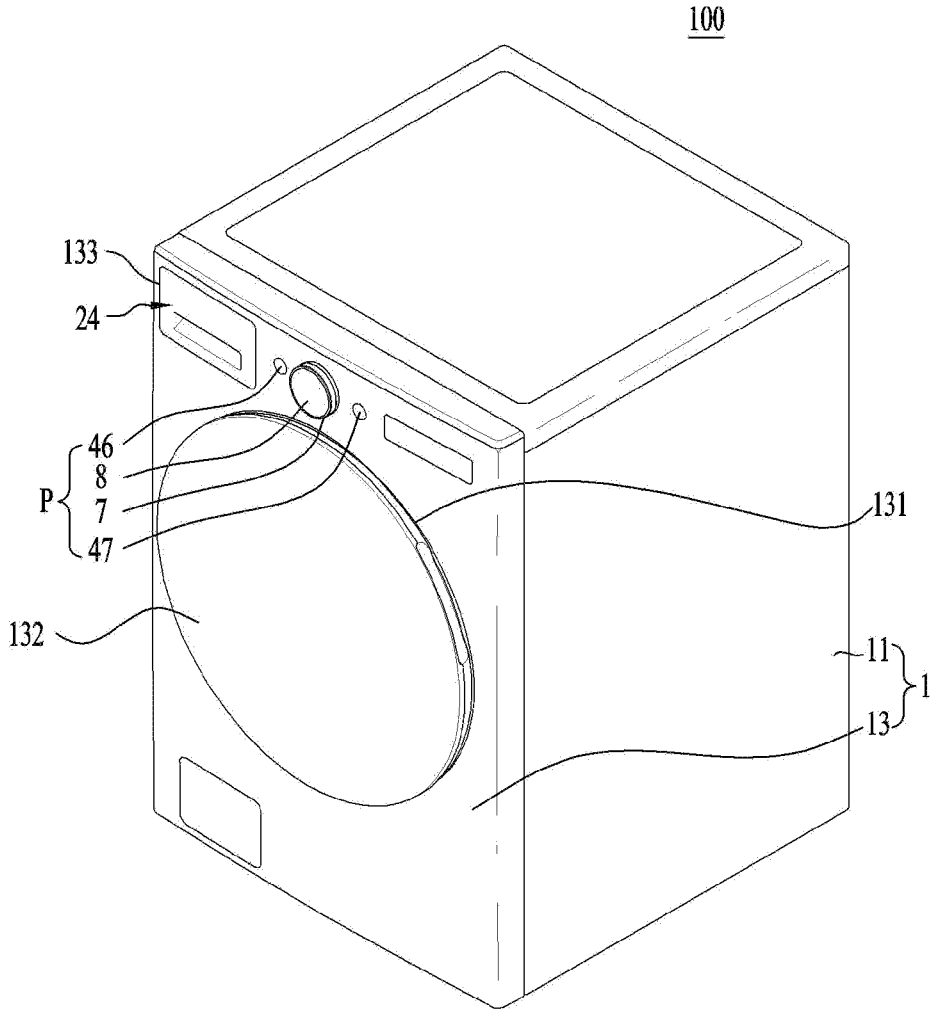
FIGS. 1 and 2 are views illustrating examples of a laundry treatment apparatus according to the embodiments of the present disclosure.

Referring to FIG. 1, the laundry treatment apparatus 100 includes a cabinet 1 and an interface (P) provided in the cabinet 1. The interface (P) described in the present application refers to a device or program that enables communication between a user and a laundry treatment apparatus (including other electronic devices including the laundry treatment apparatus). Communication between the user and the laundry treatment apparatus refers to a process in which the user inputs control commands to the laundry treatment apparatus and a process in which the laundry treatment apparatus transmits information to the user.

The cabinet 1 may be provided to include a cabinet body 11 with one open surface, and a panel 13 fixed to the one open surface of the cabinet body 11. FIG. 1 shows an example case where the cabinet body 11 is provided with an open front surface, and the panel 13 is fixed to the cabinet body 11 to form a front surface of the laundry treatment apparatus.

Figure 2:
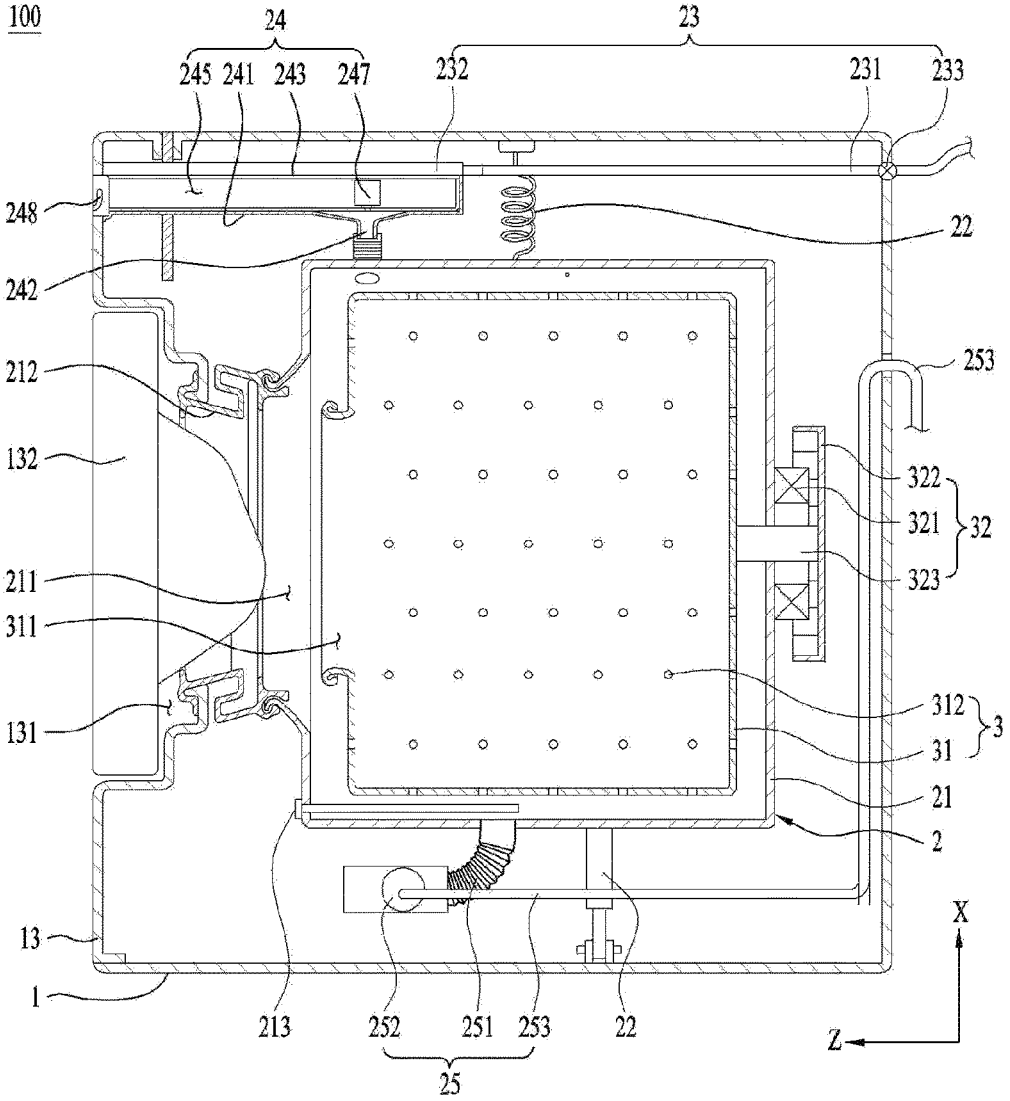

Referring to FIG. 2, the front panel 13 may be provided with a panel inlet 131 that communicates the inside of the cabinet 1 with the outside. The panel inlet 131 may be provided to be closed by a door 132 rotatably fixed to the cabinet 1.

The cabinet 1 may include a tub 2 that provides a space for storing water, and a drum 3 rotatably provided in the tub 2 to provide a space in which clothes (e.g., objects to be washed or objects to be dried) are accommodated.

The tub 2 may be provided as a cylindrical tub body 21 with an empty interior. The tub body 21 may be fixed inside the cabinet 1 through a tub support 22. FIG. 2 shows that the tub support 22 includes a spring (connecting an upper space of the tub body to the cabinet) and a damper (connecting a lower space of the tub body to the cabinet).

Among the spaces provided by the tub body 21, a tub inlet 211 may be provided on the side facing the panel inlet 131, and the panel inlet 131 and the tub inlet 211 may be connected through a gasket 212. The gasket 212 is made of an elastic material such as rubber to prevent water inside the tub body 21 from being discharged into the cabinet 1 and to minimally transmit vibration of the tub body 21 to the cabinet 1.

The tub body 21 may be equipped with a heater 213 that heats water stored in the tub. The heater 213 may be fixed to the tub body 21 to be located at a lower point than the tub inlet 211.

The tub body 21 is supplied with water through the water supply unit 23, and the water stored in the tub body 21 may be discharged to the outside of the cabinet 1 through a drain unit 25.

The drain unit 25 may include a pump 252 located at a lower point than the bottom surface of the tub body 21, a first drain pipe 251 for connecting the tub body 21 to the pump 252, and a second drain pipe 253 for guiding water discharged from the pump 252 to the outside of the cabinet.

The water supply unit 23 may be provided with a water supply pipe 231 that connects the water supply source located outside the cabinet to the tub body 21, and a water supply valve 233 that controls the opening and closing of the water supply pipe 231.

As shown in the drawing, the laundry treatment apparatus 100 may further include a detergent supply unit 24.

Figure 3:
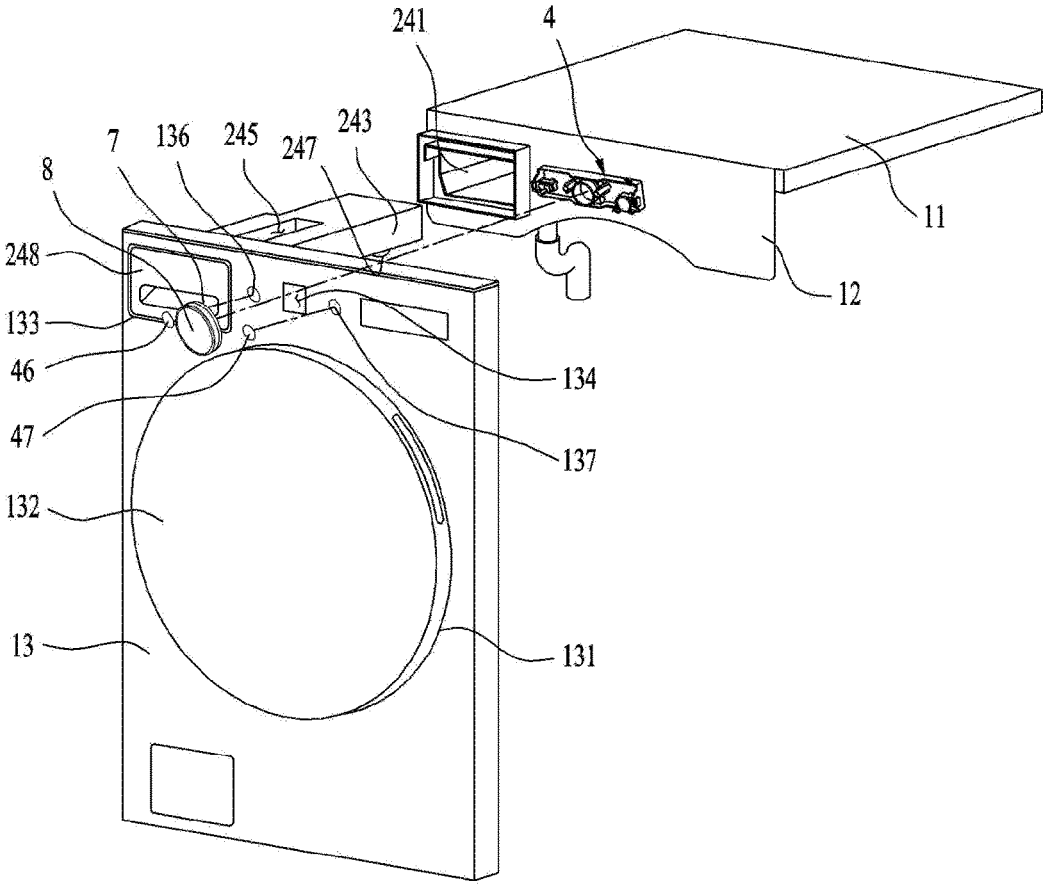
FIGS. 3 to 5 are views illustrating examples of an interface provided in the laundry treatment apparatus according to the embodiments of the present disclosure.

Referring to FIG. 3, a detergent supply unit 24 may include a drawer housing 241 provided inside the cabinet 1, a connector 242 that connects the drawer housing to the tub body 21, and a drawer 243 that can be withdrawn from the drawer housing 241 through a drawer inlet 133 provided in the front panel 13.

As shown in FIG. 2, the drawer 243 may include a chamber 245 that provides a space for storing detergent, and a discharge passage 247 that discharges the detergent inside the chamber to the drawer housing 241. The discharge passage 247 may be provided as a water trap (siphon passage, etc.) that moves liquid to the drawer housing 241 when a level of the liquid stored in the chamber 245 exceeds a preset level.

When the detergent supply unit 24 is provided in the laundry treatment apparatus 100, the water supply unit 23 may further be provided with a nozzle 232 for supplying water to the chamber 245. The nozzle 232 may be fixed to the cabinet 1 to form the upper surface of the drawer housing 241, and the water supply pipe 231 may be provided to connect the nozzle 232 to a water supply source.

A drawer panel 248 may be provided on a front surface of the drawer 243. The drawer panel 248 may be provided in a shape that closes the drawer inlet 133, and the drawer panel 248 may be provided with a drawer handle.

The drum 3 may include a cylindrical drum body 31 located inside the tub body 21, and a drive unit 32 that rotatably fixes the drum body 21 to the tub body 21.

Among the spaces provided by the drum body 31, a drum inlet 311 may be provided on the side facing the tub inlet 211. Accordingly, laundry can be input into the drum body 31 through the panel inlet 131, the tub inlet 211, and the drum inlet 311.

The drum body 31 may be provided with a drum through-hole 312 that communicates the inside of the drum body with the outside. The drum through-hole 312 may be provided on each of a circumferential surface, a front surface (surrounding the drum inlet), and a rear surface of the drum body 31. Accordingly, water or detergent supplied into the tub body 21 may be supplied into the drum body 31 through the drum through-hole 312.

The drive unit 32 may include a stator 321 that is fixed to the rear surface of the tub body 21 to form a rotating magnetic field, a rotor 322 that rotates by the rotating magnetic field, and a rotary shaft 323 that penetrates the rear surface of the tub body 21 to connect the drum body 31 to the rotor 322.

As shown in FIG. 3, the front panel 13 may be fixed to the cabinet body 11 through the panel support 12. That is, the panel support 12 may be fixed to the cabinet body 11, and the front panel 13 may be fixed to the panel support 12.

The interface (P) may be fixed to the panel support 12 or the front panel 13.

Figure 4:
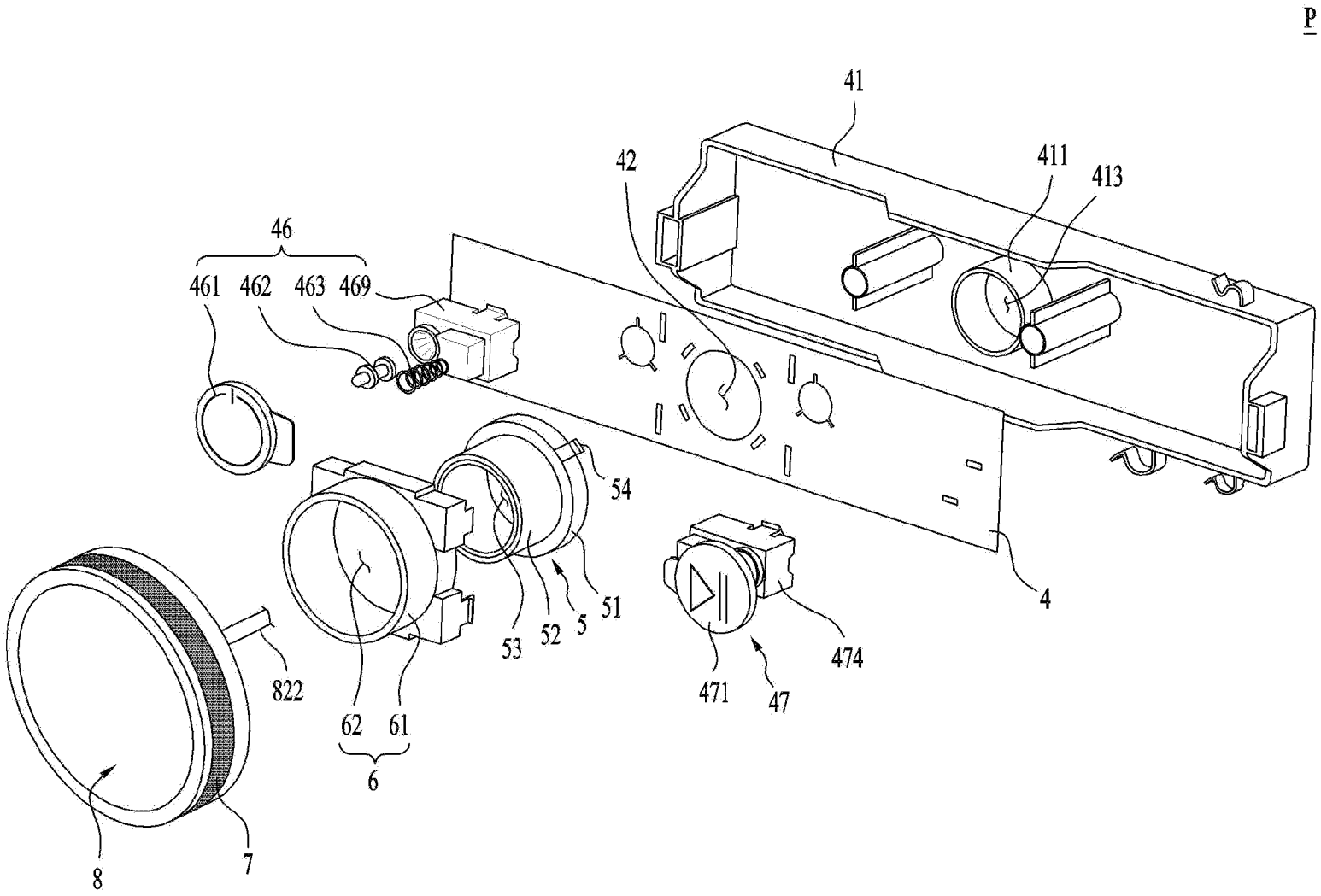

As shown in FIG. 4, the interface (P) may include a circuit board 4 (i.e., a first circuit board) located inside the cabinet 1, an encoder 5 fixed to the first circuit board and located inside the cabinet 1, an actuator 7 connected to the encoder 5 by penetrating the front panel 13, and a display unit 8 fixed to the encoder 5 by penetrating the front panel 13.

The first circuit board 4 may refer to a board equipped with a control circuit necessary for controlling (power control, operation control) at least one of the drive unit 32, the water supply valve 233, and the pump 252, and may be fixed to the front panel 13 through the case 41. The first circuit board 4 may include a first circuit board fixed to the case 41 and a circuit (first circuit) fixed to the first circuit board.

The case 41 may be provided with a position fixing unit 411 for setting the position of the first circuit board 4. In this case, the first circuit board 4 may be provided with a substrate through-hole 42 into which the position fixing unit 411 is inserted.

A wire 822 may be connected to the display unit 8. The wire 822 may be provided as a power line that supplies power to the display unit, and the display unit 8 may include a communication line that enables communication with the first circuit board 4 and devices inside the cabinet.

The position fixing unit 411 may be provided with a fixing unit through-hole 413. In this case, the wire 822 may be extended into the cabinet 1 by being inserted into the fixing unit through-hole 413.

The first circuit board 4 may further include a first input unit 46 and a second input unit 47. The first input unit 46 may be provided as a means for inputting a control command requesting power supply to the laundry treatment apparatus 100. The second input unit 47 may be provided as a means for inputting a command requesting execution of a control command displayed on the display unit 8, or a means for inputting a command requesting temporary suspension of a control command being executed by the laundry treatment apparatus 100. The first input unit 46 and the second input unit 47 may be fixed to the first circuit board so as to be connected to the first circuit.

The first input unit 46 and the second input unit 47 may be provided to generate a control signal by detecting static electricity of a user's body.

The first input unit 46 may include a first button 461 exposed to the outside of the cabinet 1, a first detection sensor 464 fixed to the first circuit board 4, and a conductor (463, first touch spring) that connects the first button to the first detection sensor. Likewise, the second input unit 47 may include a second button 471 exposed to the outside of the cabinet 1, a second detection sensor 474 fixed to the first circuit board 4, and a conductor (not shown, a second touch spring) that connects the second button to the second detection sensor.

As shown in FIG. 3, the front panel 13 may be provided with a first button mounting unit 136 and a second button mounting unit 137. The first button 461 may be exposed to the outside of the cabinet 1 through the first button mounting unit 136, and the second button 471 may be exposed to the outside of the cabinet 1 through the second button mounting unit 137.

The first input unit 46 and the second input unit 47 may be provided separately in the left space and the right space of the display unit 8, or may be provided separately in the upper space and the lower space of the display unit. The first input unit 46 and the second input unit 47 may be arranged vertically or horizontally in either the left space or the right space of the display unit.

Referring to FIG. 4, the first touch spring 463 and the second touch spring may be provided in the form of a coil, which provides restoring force to the first button 461 and the second button 471. Furthermore, in order to prevent the first button 461 and the second button 471 from being separated from the respective button mounting units 136 and 137, the first input unit 46 may include a first stopper 462 that limits the movement range of the first button, and the second input unit 47 may include a second stopper (not shown) that limits the movement range of the second button.

The encoder 5 may be a means for rotatably fixing the actuator 7 to the first circuit board 4, and may be a means for generating an electrical signal when the actuator 7 rotates (or for generating an electrical signal that is set differently depending on a rotation angle of the actuator).

The encoder 5 may include a fixing unit 51 fixed to the first circuit board 4 to allow the display unit 8 to be fixed thereto, a rotating portion 52 rotatably provided on the fixing unit 51 to allow the actuator 7 to be fixed thereto, and a signal generator 54 for generating an electrical signal when the rotating portion 52 rotates. The fixing unit 51 may be fixed to the first board, and the signal generator 54 may be fixed to the first fixing unit 51 to be connected to the first circuit. The fixing unit 51 may be provided with a body through-hole 53 connected to the substrate through-hole 42 (connected to the fixing unit through-hole).

The rotating portion 52 may be provided as a cylindrical rotary body rotatably coupled to the fixing unit 51.

The signal generator 54 may include a magnet fixed to the rotating portion 52, a sensor provided in the fixing unit 51 to detect magnetic force, and a terminal through which the first circuit provided in the first circuit board 4 is connected to the sensor. The magnet may be provided with a plurality of permanent magnets that is spaced apart from each other along the circumferential surface of the rotary body 521.

In order to prevent foreign substances from entering the encoder 5, the interface (P) may be further provided with an encoder cover 6.

The encoder cover 6 may include a pipe-shaped cover body 61 that is fixed to the first circuit board 4 and surrounds the encoder 5, and a cover through-hole 62 provided to penetrate the cover body 61 so as to allow the encoder 5 to be inserted therein.

Figure 5:
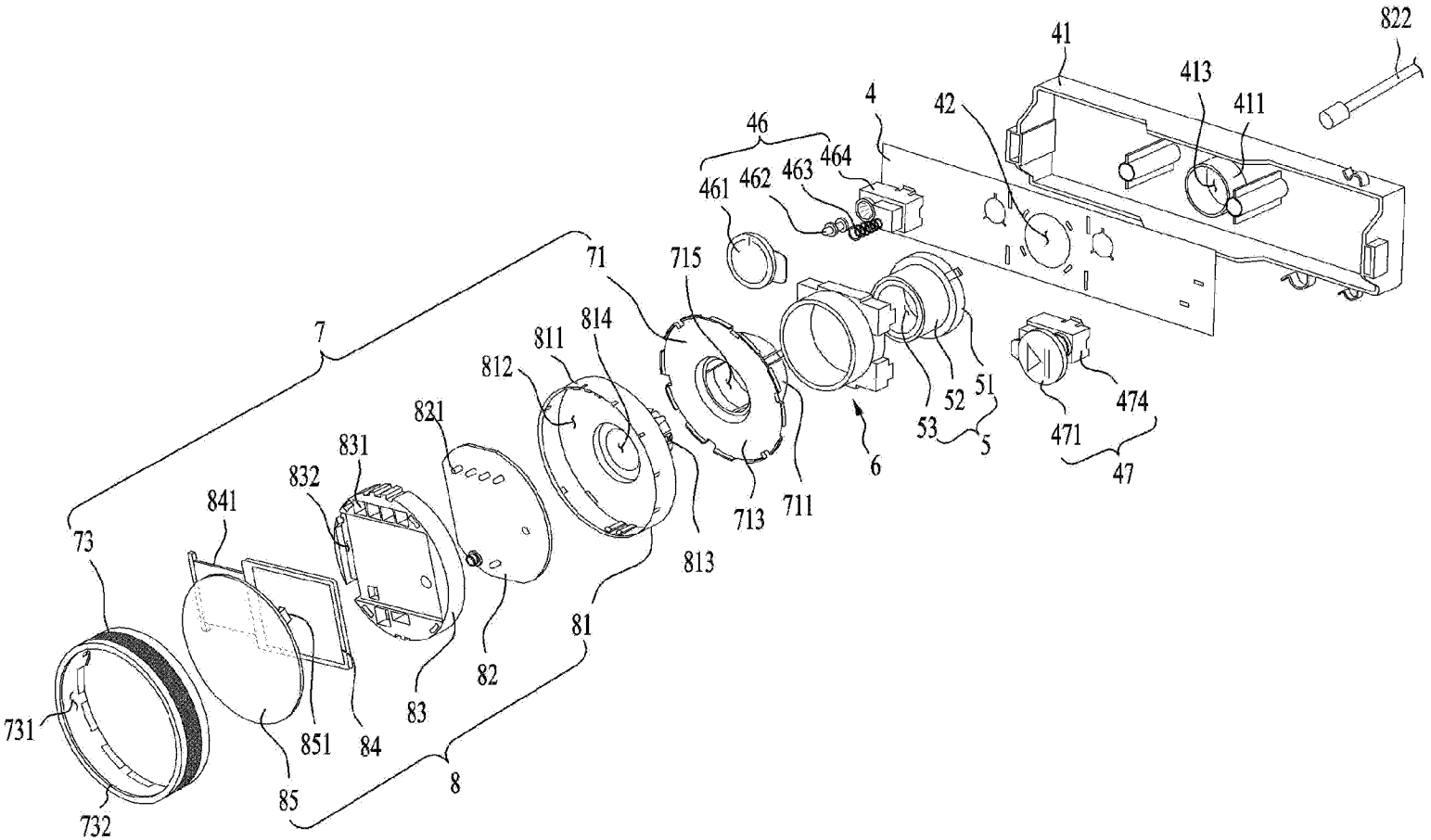

Referring to FIG. 5, the actuator 7 may include a shaft 71 fixed to the rotating portion 52 by penetrating the front panel 13, and a handle 73 fixed to the shaft 71 and located outside the cabinet 1.

The cabinet 1 may be provided with a panel through-hole 134 (see FIG. 3) formed to penetrate the front panel 13, and the shaft 71 may be provided to be inserted into the panel through-hole 134.

The shaft 71 may include a shaft body 711 fixed to the rotating portion 52, a disk-shaped base 713 fixed to the circumferential surface of the shaft body 711, and a shaft through-hole 715 connected to the body through-hole 53 by penetrating the shaft body 711.

The handle 73 may be fixed to the shaft 71 to be located outside the cabinet 1, and the user may apply force required to rotate the rotary body 521 to the shaft 71 through the handle 73.

The handle 73 may be provided in a cylindrical shape with a receiving space 731 therein. The handle 73 may be provided to be fixed to the base 713, and a handle through-hole 732 may be provided at one surface of the handle 73 to communicate the receiving space 731 with the outside.

The display unit 8 may include a housing 81 fixed to a fixing unit 51 of the encoder and located inside the receiving space 731 of the actuator; a display 84 fixed to the housing to display information (e.g., information related to control and operation of the laundry treatment apparatus); and a circuit board 82 (e.g., a second circuit board, a display-unit circuit board) provided in the housing and having a circuit for controlling the display 84.

The housing 81 may include a fastening body 813 inserted into the shaft through-hole 715 and fixed to the fixing unit 511; and a receiving body 811 fixed to the fastening body 813 and located inside the receiving space 731.

The receiving body 811 may be provided in any shape as long as it can be inserted into the receiving space 731. The drawing shows an example where the receiving body 811 is provided in a cylindrical shape.

A mounting space 812 may be formed inside the receiving body 811, and a receiving body through-hole may be provided on a surface facing a direction in which the handle through-hole 732 is located from among the spaces provided by the receiving body.

The fastening body 813 may be provided in any shape as long as it can be inserted into the shaft through-hole 715 and the body through-hole 53 of the encoder. The drawing shows that the fastening body 813 has a cylindrical shape. The fastening body 813 may include a fastening body through-hole 814 that connects the mounting space 812 to the substrate through-hole 42.

The second circuit board 82 may be inserted into the mounting space 812, and the wire 822 connected to the second circuit board 82 may be withdrawn out of the housing 81 through the fastening body through-hole 814. The second circuit board 82 may include a second circuit board and a second circuit fixed to the second circuit board.

The second circuit board 82 may be provided with a plurality of lamps 821. That is, the display unit may be provided with a plurality of lamps 821 fixed to the second circuit board to be connected to the second circuit.

The second circuit board 82 may control the display 84 to display preset information according to rotation of the handle 73 (according to an electrical signal provided from the signal generator).

The mounting unit 83 may be provided in the mounting space 812, so that the mounting unit 83 maintains a gap between the second circuit board 82 and the display 84, prevents damage to the lamp 821, and directs light emitted from the lamp 821 to the outside of the mounting space 812.

The mounting unit 83 may be provided as a mounting body that is fixed to the receiving body 811 and located inside the mounting space 812. The mounting body can be provided in any shape as long as it can be inserted into the mounting space 812, and the drawing shows an example in which the mounting body is provided in a substantially cylindrical shape.

The mounting unit 83 may include a lamp through-hole 831 into which the lamp 821 is inserted, and a connector through-hole 832. A connector (841, flexible PCB, etc.) provided on the display 84 may be inserted into the second circuit board 82 and connected to the second circuit board 82.

To prevent water and foreign substances from entering the display 84 and the second circuit board 82, the receiving body 811 may be further provided with a cover 85. The cover 85 may be fixed to the mounting unit 83 through a cover fixing protrusion 851.

The cover 85 must be made of a material that is transparent enough to allow the information displayed on the display 84 and light emitted from the lamp 821 to be viewed from the outside.

Figure 6:
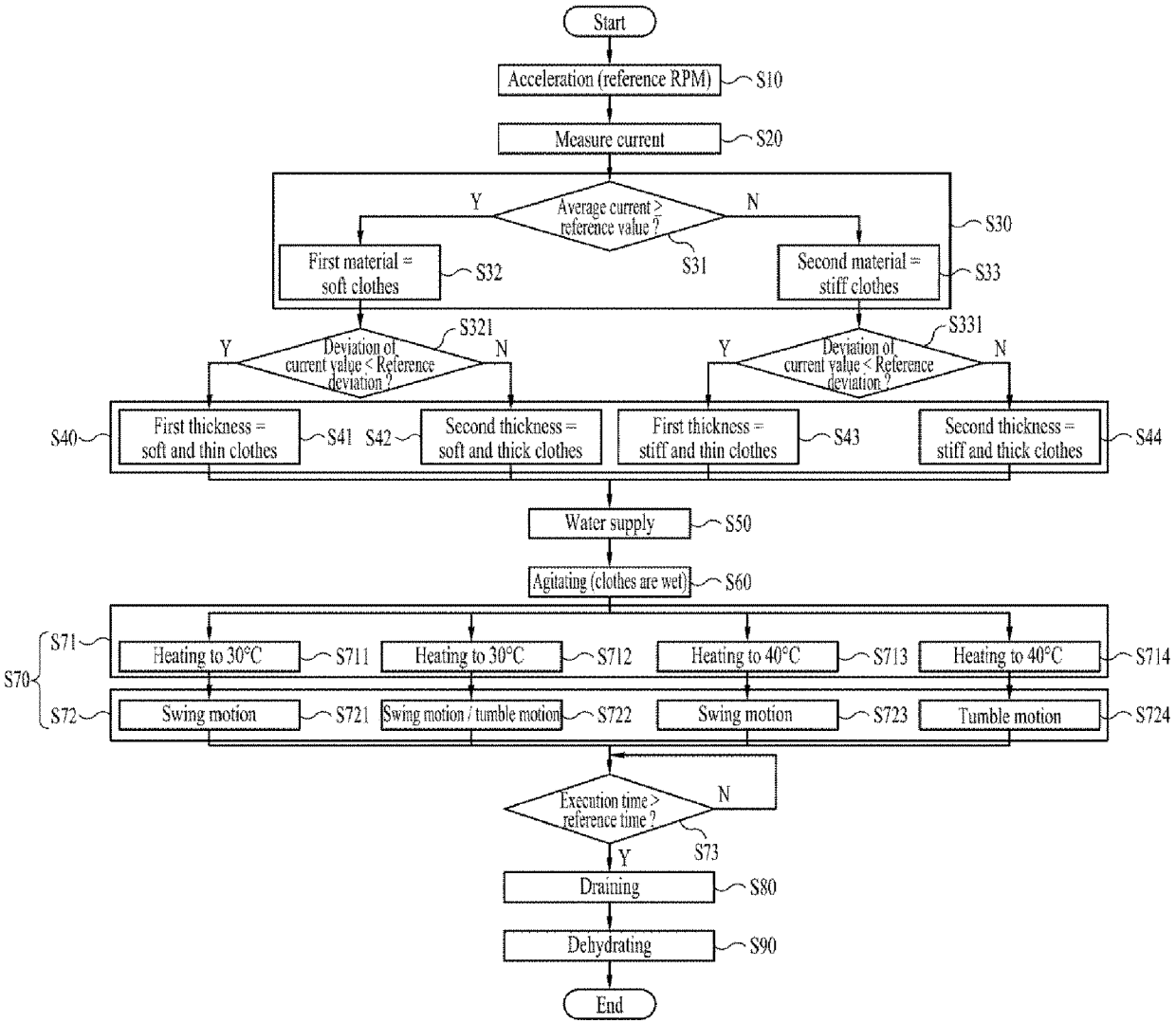
FIG. 6 is a flowchart illustrating an example of a method for controlling the laundry treatment apparatus according to the embodiments of the present disclosure.

FIG. 6 is a flowchart illustrating an example of a method for controlling the laundry treatment apparatus according to the embodiments of the present disclosure.

The control method of the laundry treatment apparatus may include increasing (S10) the number of revolutions (i.e., RPM) of the drum 3 up to a preset reference RPM; measuring (S20) an average value of the current supplied to the stator 321 during a time taken to reach the reference RPM; and distinguishing (S30) constituent materials of clothes according to whether the measured average current value is greater than or equal to a preset reference value.

When the drum 3 rotates, clothes may be lifted upward and fallen to the bottom of the drum in a repeated manner, such that external force applied to the drum may vary depending on the material of clothes.

When using relatively soft clothes (clothes made of the first material), the drum may reach the above reference RPM within a relatively short time because the soft clothes supply small external force to the drum when dropped to the bottom of the drum. Therefore, in the case of clothes made of the first material, the average value of the current supplied to the stator 321 to accelerate the drum 3 up to the reference RPM tends to be high.

In contrast, when using stiff clothes (clothes made of the second material), it may take a relatively long time to accelerate the drum 3 up to the reference RPM because large external force is supplied to the drum when dropped. Therefore, in the case of clothes made of the second material, the average value of the current supplied to the stator 321 to accelerate the drum 3 to the reference RPM tends to be low.

The above-mentioned tendency is clearly distinguished when the clothes of the first material are set to a material with a polyester content of 80% or more, and the clothes of the second material are set to a material with a polyester content of less than 80%.

Since the acceleration step (S10) and the measurement step (S20) are designed to use the above-described tendency, the reference RPM is preferably set to an RPM that applies centrifugal force of 1G to laundry inside the drum 3. Since clothes will rotate with the drum 3 when the drum 3 rotates at an RPM that applies centrifugal force of 1G or more to the clothes, the measuring step (S20) may be terminated when the RPM of the drum reaches an RPM at which centrifugal force of 1G or more is applied to the clothes.

On the other hand, when the acceleration of the drum 3 is too high, it may be difficult to confirm the above-described tendency depending on the material of clothes. This is because, when the acceleration of the drum 3 is high, there is not enough time to check (or measure the change in the amount of current supplied to the stator) the effect of falling clothes affecting rotation of the drum. Therefore, in the acceleration step (S10), the acceleration of the drum 3 is preferably maintained at the range of 1 rpm/s to 10 rpm/s. According to the experimentation, the above-described tendency could be clearly confirmed when the acceleration of the drum was maintained at the range of 3 rpm/s to 5 rpm/s in the acceleration step (S10).

The material distinguishing step (S30) may include determining whether the measured average current value is greater than or equal to a preset reference value. The reference value must be set differently depending on how the first material and the second material are set and how the reference RPM is set, and is a value that can be set through experimentation.

When the average value of the current supplied to the stator 321 during the time taken to reach the reference RPM is greater than or equal to the reference value, the material distinguishing step (S30) may include determining (32) clothes introduced into the drum 3 to be clothes made of the first material (e.g., clothes having polyester content of 80% or more). However, if the average value of the current supplied to the stator 321 during the time taken to reach the reference RPM is less than the reference value, the material distinguishing step (S30) may include determining clothes introduced into the drum 3 to be clothes made of the second material (e.g., clothes having polyester content of less than 80%).

When the material distinguishing step (S30) is completed, the control method of the laundry treatment apparatus may include a water supply step (S50) for supplying water to the tub 2 by controlling the water supply unit 23, and a treating step (S70) for separating foreign substances from the clothes by rotating the drum 3.

The treating step (S70) may include performing, according to the material of clothes distinguished by the material distinguishing step S30, at least one of a step (S71) of controlling the temperature of water stored in the tub 2 and a step (S72) of controlling the number of rotations of the drum 3.

When the treating step S70 is performed on the clothes made of the first material in water at a low temperature, this treating step S70 may advantageously separate foreign substances from the clothes and prevent damage to the clothes. When the treating step S70 is performed on the clothes made of the second material in water at a high temperature, this treating step S70 may advantageously separate foreign substances from the clothes and prevent damage to the clothes.

Therefore, when it is determined that clothes are made of the first material (S32), the treating step (S70) may include steps (S711, S712) in which water stored in the tub 2 is heated to a first preset temperature by controlling the heater 213. On the other hand, when it is determined that clothes are made of the second material, the treating step (S70) may proceed with steps (S713, S714) of heating the water stored in the tub 2 to a second temperature higher than the first temperature. The first temperature may be set to a temperature of 30° C. to 40° C., and the second temperature may be set to a temperature of 40° C. or more.

The clothes made of the first material have a higher risk of being damaged by friction with the drum 3 than the clothes made of the second material. Therefore, when the clothes are determined to be the clothes made of the first material, the treating step (S70) may alternately perform clockwise rotation of the drum 3 and counterclockwise rotation of the drum 3, and may perform the first motion execution step (S721, S722) in which the drum 3 rotates with the first number of revolutions (hereinafter referred to as 'first RPM') at which centrifugal force of less than 1G occurs.

However, when clothes are determined to be the clothes made of the second material, the treating step (S70) may cause centrifugal force of less than 1G and proceed with a second motion execution step S724 in which the drum 3 rotates at a second RPM higher than the first RPM.

Meanwhile, the control method may further include a thickness distinguishing step (S40) for determining the thickness of clothes. The thickness distinguishing step (S40) should be started after completion of the material distinguishing step (S30).

Since the weight of thick clothes is heavier than that of thin clothes, when the clothes are dropped (or fall), external force supplied by the thick clothes to the drum 3 is greater than external force supplied to the drum by the thin clothes. This means that the deviation per unit time of the current supplied to the stator 321 to accelerate the drum 3 to the reference RPM can be observed differently depending on the thickness of the clothes.

Therefore, when it is determined that the deviation per unit time of the current supplied to the stator 31 while accelerating the drum 3 to the reference RPM is less than a preset reference deviation (S321, S331), the thickness distinguishing step (S40) may determine that the clothes put into the drum are thin clothes (clothes of the first thickness) (S41, S43). However, if the deviation per unit time of the current supplied to the stator 31 while accelerating the drum 3 to the reference RPM is greater than the reference deviation, the thickness distinguishing step (S40) may determine whether clothes put into the drum are thick clothes (clothes of the second thickness) (S42, S44).

The reference deviation must be set differently depending on the material of the clothes, the reference RPM, and the thickness of clothes to be distinguished, and is a value that can be set through experimentation.

The thickness distinguishing step (S40) may be performed even if the clothes are determined to be the clothes made of the first material (S32), and may also be performed even if the clothes are determined to be the clothing made of the second material (S33).

That is, when it is determined that the object to be treated in the drum is the clothes made of the first material (S32), the thickness distinguishing step (S40) may include determining (S42) whether the object to be treated in the drum 3 is the thin clothes made of the first material or the thick clothes made of the first material according to whether the deviation per unit time of the current is less than the reference deviation (S321).

Likewise, if it is determined (S33) that the object to be treated in the drum is the clothes made of the second material, the thickness distinguishing step (S40) may include determining (S44) whether the object to be treated in the drum is the thin clothes made of the second material or the thick clothes made of the second material according to whether the deviation per unit time of the current is less than the reference deviation (S331).

When the thickness distinguishing step (S40) is completed, the control method proceeds to the water supply step (S50). When the water supply step (S50) is completed, the control method may immediately proceed to the treating step (S70), or may proceed to the treating step (S70) after completing the agitating step (S60).

The agitating step (S60) is a process in which the water supplied to the tub 2 and the detergent supplied through the detergent supply unit 24 are evenly supplied to the clothes. The agitating step (S60) may facilitate separation of foreign substances from the clothes in a subsequent treating step (S70), and may minimize the amount of detergent remaining in the tub or the clothes after completing the treating step (S70).

When the thickness distinguishing step (S40) is provided, the treating step (S70) may be provided as follows.

When it is determined (S41) that the clothes made of the first material are the clothes made of the first thickness, the treating step (S70) may include a heating step (S711) of heating the water to 30° C., and a first motion execution step S721 in which clockwise rotation of the drum 3 and counterclockwise rotation of the drum 3 are alternately performed and the drum 3 rotates at a first RPM at which centrifugal force of less than 1G occurs.

When dividing the internal space of the drum 3 into an upper space located above the horizontal line passing through the center of rotation of the drum and a lower space located below the horizontal line, the first RPM is preferably set to the number of revolutions (RPM) at which clothes inside the drum 3 can move in the lower space. The first motion (swing motion) implemented through the first motion execution step (S721) may be set as a motion in which the drum rotates in only one of a clockwise direction and counterclockwise direction.

When the clothes made of the first material are confirmed to be the clothes made of the second thickness (S42), the treating step (S70) may include a heating step (S712) in which water is heated to 30° C. and centrifugal force of less than 1G occurs, and a second motion execution step (S722) in which the drum 3 rotates at the second RPM higher than the first RPM.

However, when the clothes made of the first material are confirmed to be the clothes made of the second thickness (S42), the motion execution step (S722) performed after completion of the heating step (S712) may be provided to alternately perform the first motion execution step and the second motion execution step.

The second motion (tumble motion) implemented through the second motion execution step (S722) may be implemented as a motion that alternately executes clockwise rotation and counterclockwise rotation of the drum.

Meanwhile, when the clothes made of the second material are confirmed to be the clothes made of the first thickness (S43), the treating step (S70) may include heating (S713) water to 40° C., and executing (S723) the first motion. When the clothes made of the second material are confirmed to be the clothes of the second thickness (S44), the treating step S70 may include the heating step S714 in which water is heated to 40° C., and the second motion execution step S724 in which centrifugal force of less than 1G occurs and the drum 3 rotates with the second RPM higher than the first RPM.

When the execution time of the treating step (S70) reaches the preset reference time (S73), the operation is terminated. When the treating step (S70) is completed, the control method may perform a drain step (S80) of draining the water stored in the tub 2 through the drain unit 25, and a dehydration step (S90) in which the drum rotates with the RPM at which centrifugal force of 1G or more occurs in the clothes so that dehydration of the clothes is performed.

The above-described control method is characterized in that the laundry treatment apparatus distinguishes the material of the clothes by measuring the current supplied to the stator 321 during the acceleration step (S10) and distinguishes the thickness of the clothes through the deviation per unit time of the current supplied to the stator, but the scope of the present disclosure is not limited thereto, and the laundry treatment apparatus may also be provided to distinguish the material of the clothes and the thickness of the clothes through the amount of current measured in the process of decelerating the drum.

That is, after completing the acceleration step (S10), the control method may proceed with a deceleration step (not shown), and the measurement step (S20) may measure the amount of current supplied to the stator 321 (or the amount of current flowing in the coil of the stator by electromotive force) when the deceleration step is performed.

The deceleration step is a process of performing deceleration from the reference RPM to a preset deceleration reference RPM (e.g., 0 RPM or a specific RPM set lower than the reference rpm). In the deceleration step, the acceleration of the drum 3 may range from −1 rpm to −10 rpm (or −3 rpm/s to −5 rpm/s). In this case, the step (S31) of comparing the average current value with the reference value may include comparing the average value of the current supplied to the stator 321 with the reference value during the time taken to reach the reference deceleration RPM.

The above-described embodiments are described based on the laundry treatment apparatus capable of washing clothes. However, since the control method can distinguish the material and thickness of clothes without supplying water to the tub, the steps for determining the material and thickness of clothes can also be applied to a laundry treatment apparatus for drying the clothes.

Since the structure and control method of the above-described laundry treatment apparatus relate to the above-described embodiments, the scope of the present application is not limited thereto.

The invention claimed is:

1. A method for controlling a laundry treatment apparatus that includes a tub to store water therein, a drum provided inside the tub to accommodate clothes, a stator to form a rotating magnetic field, and a rotor rotated by the rotating magnetic field and connected to the drum through a rotary shaft, the method comprising:

an acceleration step of accelerating the drum so that a revolutions per minute (RPM) of the drum increases to a reference RPM;

a material-distinguishing step of determining materials of the clothes according to whether an average value of a current supplied to the stator during a time taken to reach the reference RPM is greater than or equal to a reference value;

a thickness-distinguishing step of determining a thickness of the clothes according to whether a deviation per unit time of the current supplied to the stator during the material-distinguishing step is less than a reference deviation;

a water supply step of supplying water to the tub after the thickness-distinguishing step is completed; and a treating step of rotating the drum to separate foreign substances from the clothes after the water supply step is completed, wherein the treating step comprises differently controlling at least one of a temperature of the water stored in the tub or the RPM of the drum based on (i) the materials of the clothes determined through the material-distinguishing step and (ii) the thickness of the clothes determined through the thickness-distinguishing step.

2. The method according to claim 1, wherein:

the reference RPM is set to an RPM that applies centrifugal force of 1G to the clothes located inside the drum.

3. The method according to claim 2, wherein the acceleration step includes:

controlling acceleration of the drum to be maintained at 1 rpm/s to 10 rpm/s.

4. The method according to claim 2, wherein the acceleration step includes:

controlling acceleration of the drum to be maintained at 3 rpm/s to 5 rpm/s.

5. The method according to claim 2, wherein the material-distinguishing step includes:

based on the average value of the current supplied to the stator during the time taken to reach the reference RPM being greater than or equal to the reference value, determining a material of the clothes to be a first material in which a polyester content of the clothes put into the drum is 80% or more; and based on the average value of the current supplied to the stator during the time taken to reach the reference RPM being less than the reference value, determining a material of the clothes to be a second material in which a polyester content of the clothes put into the drum is less than 80%.

6. The method according to claim 5, wherein the treating step includes:

based on the clothes being determined to be the clothes made of the first material, heating the water stored in the tub to 30° C. using a heater provided in the tub.

7. The method according to claim 6, wherein the treating step includes:

based on the clothes being determined to be the clothes made of the second material, heating the water stored in the tub to 40° C.

8. The method according to claim 1, wherein the thickness-distinguishing step includes:

based on the deviation per unit time of the current supplied to the stator during the material-distinguishing step being less than the reference deviation, determining the thickness of the clothes to be a first thickness smaller than a reference thickness; and based on the deviation per unit time of the current supplied to the stator during the material-distinguishing step being greater than or equal to the reference deviation, determining the thickness of the clothes to be a second thickness larger than the reference thickness.

9. The method according to claim 8, wherein:

based on determining that the clothes are made of a first material and have the first thickness, the treating step includes:

a heating step of heating the water to 30° C.; and a step of executing a first motion in which a clockwise rotation of the drum and a counterclockwise rotation of the drum are alternately performed and the drum rotates at a first RPM at which centrifugal force of less than 1G occurs.

10. The method according to claim 9, wherein:

based on determining that the clothes are made of the first material and have the second thickness, the treating step includes:

a heating step of heating the water to 30° C.; and a second motion execution step of causing centrifugal force of less than 1G and rotating the drum at a second RPM higher than the first RPM.

11. The method according to claim 9, wherein:

based on determining that the clothes are made of the first material and have the second thickness, the treating step includes:

a heating step of heating the water to 30° C.;

a first motion execution step of alternately performing the clockwise rotation of the drum and the counterclockwise rotation of the drum, and rotating the drum at the first RPM at which centrifugal force of less than 1G occurs; and a second motion execution step of causing centrifugal force of less than 1G and rotating the drum at a second RPM higher than the first RPM, wherein the first motion execution step and the second motion execution step are executed alternately.

12. The method according to claim 9, wherein:

based on determining that the clothes are made of a second material and have the first thickness, the treating step includes:

a heating step of heating the water to 40° C.; and a first motion execution step of performing the first motion.

13. The method according to claim 9, wherein:

based on determining that the clothes are made of a second material and have the second thickness, the treating step includes:

a heating step of heating the water to 40° C.; and a second motion execution step of causing centrifugal force of less than 1G and rotating the drum at a second RPM higher than the first RPM.

14. A method for controlling a laundry treatment apparatus that includes a tub to store water therein, a drum provided inside the tub to accommodate clothes, a stator to form a rotating magnetic field, and a rotor rotated by the rotating magnetic field and connected to the drum through a rotary shaft, the method comprising:

an acceleration step of accelerating the drum so that a revolutions per minute (RPM) of the drum increases to a preset reference RPM;

a deceleration step of decelerating the drum so that an RPM of the drum decreases to a deceleration reference RPM lower than the preset reference RPM;

a material-distinguishing step of determining materials of the clothes according to whether an average value of a current supplied to the stator during a time taken to reach the deceleration reference RPM is greater than or equal to a preset reference value;

a thickness-distinguishing step of determining a thickness of the clothes according to whether a deviation per unit time of the current supplied to the stator during the material-distinguishing step is less than a preset reference deviation;

a water supply step of supplying water to the tub after the thickness-distinguishing step is completed; and a treating step of rotating the drum to separate foreign substances from the clothes after the water supply step is completed, wherein the treating step comprises differently controlling at least one of a temperature of the water stored in the tub or the RPM of the drum based on (i) the material of the clothes determined through the material-distinguishing step and (ii) the thickness of the clothes determined through the thickness-distinguishing step.

15. The method according to claim 1, wherein the thickness-distinguishing step is performed between the material-distinguishing step and the water supply step.

16. The method according to claim 1, wherein differently controlling at least one of the temperature of the water stored in the tub or the RPM of the drum comprises:

adjusting the temperature of the water stored in the tub based on the materials and the thickness of the clothes; and adjusting the RPM of the drum based on the materials and the thickness of the clothes.

* * * * *